US007560822B1

(12) United States Patent
Hoffmann

(10) Patent No.: US 7,560,822 B1
(45) Date of Patent: Jul. 14, 2009

(54) EDUCATIONAL ELECTRICAL GENERATION KIT

(76) Inventor: Gregory C. Hoffmann, 1009 N. Second St., Watertown, WI (US) 53098

( * ) Notice: Subject to any disclaimer, the term of this patent is extended or adjusted under 35 U.S.C. 154(b) by 156 days.

(21) Appl. No.: 11/424,761

(22) Filed: Jun. 16, 2006

Related U.S. Application Data

(60) Provisional application No. 60/693,340, filed on Jun. 22, 2005.

(51) Int. Cl.
*F02B 63/04* (2006.01)
*A63B 71/00* (2006.01)

(52) U.S. Cl. ..... 290/1 R; 482/57; 482/2

(58) Field of Classification Search ..... 290/1 R; 310/75 C, 67 A, 57 B; 180/2.2, 205; 482/57, 482/2, 63
See application file for complete search history.

(56) References Cited

U.S. PATENT DOCUMENTS

| | | | | |
|---|---|---|---|---|
| 3,031,247 | A * | 4/1962 | Schieve | 312/231 |
| 3,240,947 | A * | 3/1966 | Mas | 290/50 |
| 4,026,040 | A | 5/1977 | Valentine et al. | |
| 4,048,511 | A * | 9/1977 | Watanabe | 290/1 R |
| 4,298,893 | A * | 11/1981 | Holmes | 348/730 |
| 4,376,538 | A | 3/1983 | Keenan | |
| 4,545,766 | A | 10/1985 | Schoessow | |
| 4,613,129 | A * | 9/1986 | Schroeder et al. | 482/63 |
| 4,637,274 | A * | 1/1987 | Goldenfeld | 74/625 |
| 4,709,917 | A * | 12/1987 | Yang | 482/63 |
| 5,316,101 | A * | 5/1994 | Gannon | 180/221 |
| 5,720,464 | A * | 2/1998 | Meinscher et al. | 248/447 |
| 6,717,280 | B1 * | 4/2004 | Bienville | 290/1 R |
| 6,748,873 | B2 * | 6/2004 | Brown, Sr. | 108/6 |
| 6,987,327 | B1 * | 1/2006 | Lucatero | 290/1 A |
| 7,005,757 | B2 * | 2/2006 | Pandian | 290/1 R |
| 2004/0227491 | A1 * | 11/2004 | Heiser et al. | 320/132 |

OTHER PUBLICATIONS

Energy Bike Programs, http://www.ohioenergy.org/energy_bike.htm, 2002, pp. 1, 2.*

Energy Bike, http://www.NEED.org. 2005, pp. 1-6, 13-16, 20-22,24-27,31-33,35-40,44-45,47, 49-53,57-61.*

McCullagh, J. et al., 1928, Pedal power in work, leisure, and transportation, pp. 65, 80-86.

Pedal Powered Generator, http://web.archive.org/web/19980213110401/http://www.losgatos.ca.us/davidbu/pedgen.html.

LabVIEW Bicycle Generator Science Project with LabJACK. http://web.archive.org/web/20030215165518/www.scienceshareware.com/bike_gen.htm.

(Continued)

*Primary Examiner*—Julio Gonzalez
(74) *Attorney, Agent, or Firm*—Craig A. Fieschko, Esq.; DeWitt Ross & Stevens S.C.

(57) ABSTRACT

An educational electrical generation kit includes a bicycle wheel support which may accommodate the driven wheel of a bicycle, and wherein a generator engages the driven bicycle wheel to generate electricity. The kit also includes a display board with various electrical output meters and/or electrical loads for monitoring and/or dissipating the electrical output from the bicycle. The kit is designed to be readily portable and easily set up and torn down, and to allow a spectator/participant to incorporate a bicycle of virtually any size into the bicycle wheel support to interactively generate electricity for use in the display board.

20 Claims, 2 Drawing Sheets

OTHER PUBLICATIONS

Diagram for Bicycle Generator Science Project, http://web.archive.org/web/20021015032145/www.scienceshareware.com/bike_gen_diag.htm.

The Pedal_a_Watt Stationary Bik Power Generator, http://web.archive.org/web/20021207090323/www.econovergence.net/electro.htm.

The Pedal_a_Watt Stationary Bike Power Generator, http://web.archive.org/web/20010331040040/www.econvergence.net/electro.htm.

The Energy Bike, http://web.archive.org/web/20020208130251/www.ohioenergy.org/energybike.htm.

* cited by examiner

EDUCATIONAL ELECTRICAL GENERATION KIT

CROSS-REFERENCE TO RELATED APPLICATIONS

This application claims priority under 35 USC §119(e) to U.S. Provisional Patent Application 60/693,340 filed 22 Jun. 2005, the entirety of which is incorporated by reference herein.

FIELD OF THE INVENTION

This document concerns an invention relating generally to power generation and educational displays, and more specifically to an educational display illustrating principles of electrical power generation.

BACKGROUND OF THE INVENTION

As concern over energy conservation and the environmental effects of power generation grows, there is increased interest in teaching the public about electricity, electrical safety, and the mechanics of power generation. Thus, many schools, museums, and utilities now feature exhibits on these subjects. These may simply take the form of "passive" displays which, for example, simply illustrate in textual or graphic form the power consumed by everyday electrical appliances—for example, the energy consumed by (and the cost of) running incandescent lights, fluorescent lights, stoves, microwave ovens, etc. Such displays may be viewed by multiple people at the same time, but because of their lack of interactivity, they fail to capture the attention of many viewers. Other displays may be more "active," such as desktop displays used in the classroom which allow users to construct circuits with LEDs, small incandescent bulbs and motors, resistors, capacitors, etc. to learn basic principles of electricity. Here the displays capture the viewers' attention, but multiple sets of displays are needed to allow multiple users to participate. Thus, in both of the foregoing cases, the displays have limited utility since they cannot easily be transported from place to place—e.g., to different classrooms, museums, and exhibitions and other public events—and/or require significant setup and teardown efforts even when they can be transported.

Also, in both of the foregoing cases, while the displays can illustrate the cost of electrical power to some degree, these teachings do not carry significant impact since the displays simply use batteries, electrical wall sockets, or other readily-available power supplies, which do little to impart appreciation of the true effort needed for electrical power generation. The electricity utilized by the displays simply appears and is ready for immediate use, without any thought about its source or effort on the part of the participants.

SUMMARY OF THE INVENTION

The invention involves an electrical generation kit which is intended to at least partially address the aforementioned issues. To give the reader a basic understanding of some of the advantageous features of the invention, following is a brief summary of a preferred exemplary version of the kit, with reference being made to the accompanying drawings to enhance the reader's understanding. Since this is merely a summary, it should be understood that more details regarding the preferred version of the kit may be found in the Detailed Description set forth elsewhere in this document. The claims set forth at the end of this document then define the various versions of the kit in which exclusive rights are secured.

Referring to FIGS. 1 and 2, the exemplary electrical generation kit 100 includes a display board 102 with one or more electrical output meters (e.g., voltmeters 104, ammeters 106*a*/106*b*, wattmeters 108), electrical loads 110/112 (or electrical sockets 114 for load connection), or other electrical components thereon for use in investigating and demonstrating principles of electricity. The kit 100 also includes a bicycle wheel support 116 which includes a generator 118, and which is adaptable to receive the driven wheel 202 of a bicycle 200 therein to drive the generator 118. This arrangement allows a selected participant to install his/her bicycle 200 in the bicycle wheel support 116 and pedal it to generate electricity from the generator 118, which can then be supplied to the display board 102 for purposes of investigation and demonstration (e.g., the participant's output can be measured, different loads can be applied to illustrate the work required to operate the load, etc.). The bicycle wheel support 116 and display board 102 will now be discussed in turn in greater detail.

The bicycle wheel support 116, which is illustrated in greater detail in FIG. 2, includes a pair of spaced bicycle wheel support legs 120 which bear opposing axle engagements 122 for engaging the axle of a bicycle wheel 202. The support legs 120 extend downwardly to leg bases 124, which are preferably joined by a support base 126 which rests on the ground. In the version of the bicycle wheel support 116 depicted in the drawings, the support legs 120 are themselves supported by supplementary support legs 120*a* which are joined by a supplementary support base 126*a*. Preferably, at least one of the axle engagements 122 is threadably affixed to its bicycle wheel support leg 120, whereby the axle engagement 122 may be threadably extended toward the other axle engagement 122 (as by rotating adjustment knob 128) so that bicycle wheels 202 having different widths may be engaged and disengaged between the axle engagements 122 to be rotatably supported above the ground.

The generator 118 is affixed to the bicycle wheel support 116 so that when a bicycle wheel 202 is engaged between the axle engagements 122, the bicycle wheel 202 will engage (ride against) the protruding generator shaft 130 of the generator 118 so that driving the bicycle wheel 202 will power the generator 118. To allow the generator 118 to engage bicycle wheels 202 of different diameters, the generator 118 is preferably situated on a generator mount 132 which is pivotally affixed with respect to the bicycle wheel support 116. This pivotable mounting allows the axis of the generator shaft 130 to travel in an arc intersecting the circumference of any bicycle wheel 202 engaged within the axle engagements 122, and to deflect to accommodate bicycle wheels 202 having different diameters. As shown in FIG. 2, this can be accomplished by providing a bridge member 134 which extends upwardly from the support base 126, and then providing a generator adjustment rod 136 which extends from the bridge member 134 along a generator adjustment axis parallel to the bicycle axle axis (as defined between the axle engagements 122). The generator mount 132 can then be formed as a simple cradle or yoke which holds the generator 118, and which pivots about the generator adjustment rod 136. As a result, the generator 118 orbits a generator adjustment axis defined by the generator adjustment rod 136 so that the generator shaft 130 may be adjustably respaced with respect to a bicycle wheel 202 resting between the axle engagements 122. The generator mount 132 is then preferably elastically biased toward the bicycle axle axis (as defined between the axle engagements 122) so that the generator shaft 130 is urged into engagement with any bicycle wheel 202 resting between the axle engagements 122, and this can simply be effected by providing an elastic member 138 (such as a bungee cord) between the generator mount 132 and the bicycle wheel support 116. To allow the pivotable generator 118 further ability to accommodate differently sized and/or configured bicycle wheels 202, the generator mount 132 is also preferably translatable along the generator adjustment axis (as by having the generator adjustment rod 136 axially repositionable within the bridge member 134, and/or by having the generator mount 132 respositionable along the generator adjustment rod 136), thereby allowing the generator 118 to be moved to one side to accommodate wider bicycle wheels 202. Additionally, to better accommodate bicycle wheels 202 having very small or very large diameters, the bridge member 134 preferably bears multiple adjustment rod apertures 140, whereby the generator adjustment rod 136 may be fit into a selected one of the adjustment rod apertures 140 to allow the generator mount 132 to pivot about a selected generator adjustment axis.

The display board 102 has a front board face 142 (FIG. 1) and a rear board face 144 (FIG. 2), wherein the front board face 142 bears the aforementioned electrical components for observation and/or manipulation by students or other participants. Preferably, the front board face 142 includes one or more loads (e.g., lamps 110/112, motors, heaters, etc.), or sockets 114 allowing participants to electrically connect loads (e.g., common household items such as kitchen appliances, hairdryers, etc.), with the loads being directly or switchably connected to the generator 118 whereby participants can observe the amount of work (i.e., bicycle input) it requires to operate the loads. The front board face 142 can alternatively or additionally include capacitors, inductors, and resistors or other loads, which might be switchably connected so that different circuits may be formed between them, so that users can experiment with basic electrical components and their principles of operation. These various components are preferably provided in conjunction with one or more electrical output meters 104/106*a*/106*b*/108 allowing participants to monitor the output of the generator 118, the draw of the load(s) 110/112, or other quantities.

The display board 102 is preferably supported above the ground in an at least substantially vertical orientation for high visibility, ideally at such a height that a participant operating the bicycle 200 might also see and operate the display board 102. It is sturdily and durably configured, particularly since it may be used in crowded environments with children present (e.g., in schools, science fairs, Earth Day events, open houses at utility companies, museums, etc.). A useful construction, as particularly illustrated in FIG. 2, is to provide the rear board face 144 with at least three telescopically extendable board support legs 146 arrayed in a row across the rear board face 144, with at least one of the board support legs 146 (e.g., the central leg) being pivotally mounted to swing about an axis with respect to the rear board face 144 so that the legs can form a supporting tripod for the display board 102. One or more leg support struts 148 are then provided, one for each of the pivotable board support legs 146, wherein each leg support strut 148 is pivotally mounted at a pivot end 150 to swing from the rear board face 144 about an axis to move into engagement with its corresponding board support leg 146. Opposite its pivot end 150, the leg support strut 148 has an engagement end 152 configured to engage its corresponding board support leg 146 when the board support leg 146 and the leg support strut 148 are unfolded from the display board 102. A preferred arrangement here is to have the strut engagement end 152 of the leg support strut 148 bear an aperture, thereby defining a hook-like strut engagement end 152, wherein the hook engages the board support leg 146. As an example, the board support leg 146 may bear a slot 154 which faces toward the rear board face 144, and when the board support leg 146 is unfolded, the leg support strut 148 may be unfolded to have the hook of its strut engagement end 152 fit into the slot 154 and engage the wall of the (hollow) board support leg 146.

To further reinforce the display board 102, it is preferably supported on its rear face by a framework of members, illustrated in FIG. 2 by the top tubular support 156, bottom tubular support 158, and adjoining intermediate tubular supports 160. Conveniently, one or more of the board support legs 146 can be pivotally mounted to swing about the top tubular support 156 to move between their unfolded (supporting) and folded positions, and the leg support strut 148 can similarly be pivotally mounted to swing about the bottom tubular support 158 to move between its unfolded position in engagement with the middle board support leg 146, and its folded position adjacent the display board 102.

The foregoing arrangement allows the display board 102 to have its board support legs 146 telescopically collapsed and folded against the display board 102, and compactly transported to a school or other demonstration site along with the bicycle wheel support 116. The display board 102 may then be erected and connected to the generator 118 of the bicycle wheel support 116, which may have the bicycle 200 of a participant installed by inserting the axle of the (driven) bicycle wheel 202 into the axle engagements 122 with the bicycle wheel riding against the generator shaft 130 (which is shown bearing teeth 162, see FIG. 2, for better engagement with the bicycle wheel). Owing to the pivoting (and translatable) mounting of the generator mount 132, the generator shaft 130 will deflect to accommodate bicycle wheels 202 of virtually any size, with the elastic member 138 (FIG. 2) holding the generator shaft 130 against the wheel. (Note that the use of a removable bungee cord as the elastic member 138, with the bungee cord 138 hooked about an axle engagement 122 and extending downwardly to the generator mount 132, allows the elastic member 138 to be installed after the wheel of the bicycle 200 is installed between the axle engagements 122, thereby preventing the elastic biasing of the generator mount 132 and its generator 118 from interfering with the installation of the bicycle wheel.) The participant may then pedal his/her bicycle 200 to power the generator 118, and an operator (or the participant on the bicycle 200) may monitor his/her output on the display board 102, switch between different loads or other components on the display board 102, add new/different loads to different sockets 114, etc. Since the display board 102 is human-powered, observers are provided with a better notion of the work needed to generate the power required to operate common loads.

Further advantages, features, and objects of the invention will be apparent from the remainder of this document in conjunction with the associated drawings.

DETAILED DESCRIPTION OF PREFERRED VERSIONS OF THE INVENTION

Figure 1:
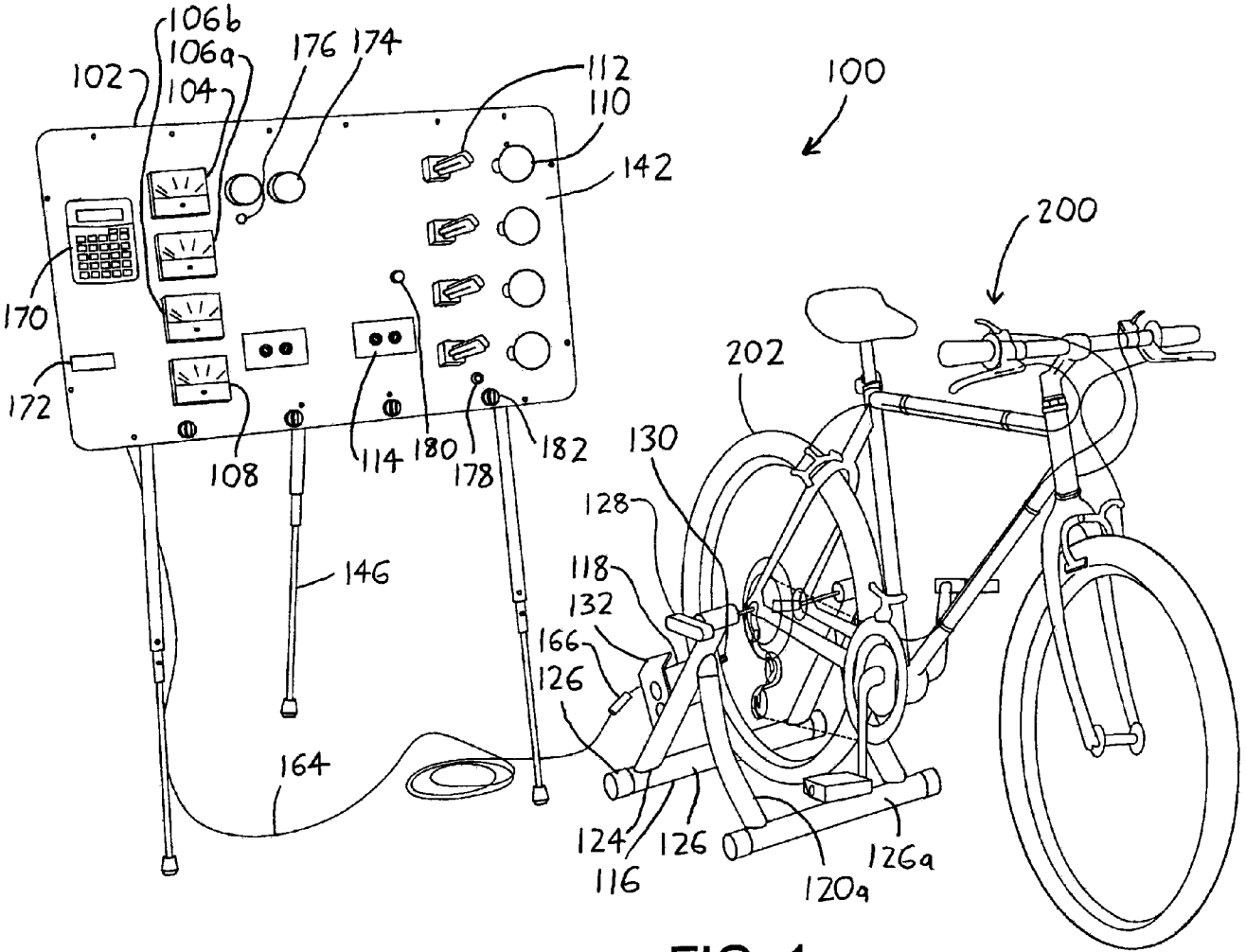
FIG. 1 is a front perspective view of an exemplary electrical generation kit 100 featuring a display board 102 having a variety of electrical output meters (voltmeter 104, ammeters 106*a*/106*b*, wattmeter 108) and loads (lamps 110 and 112) which receive electricity generated by a bicycle 200 in a bicycle wheel support 116, more specifically by a generator 118 on the bicycle wheel support 116 which is driven by the driven wheel 202 of the bicycle 200.
Figure 2:
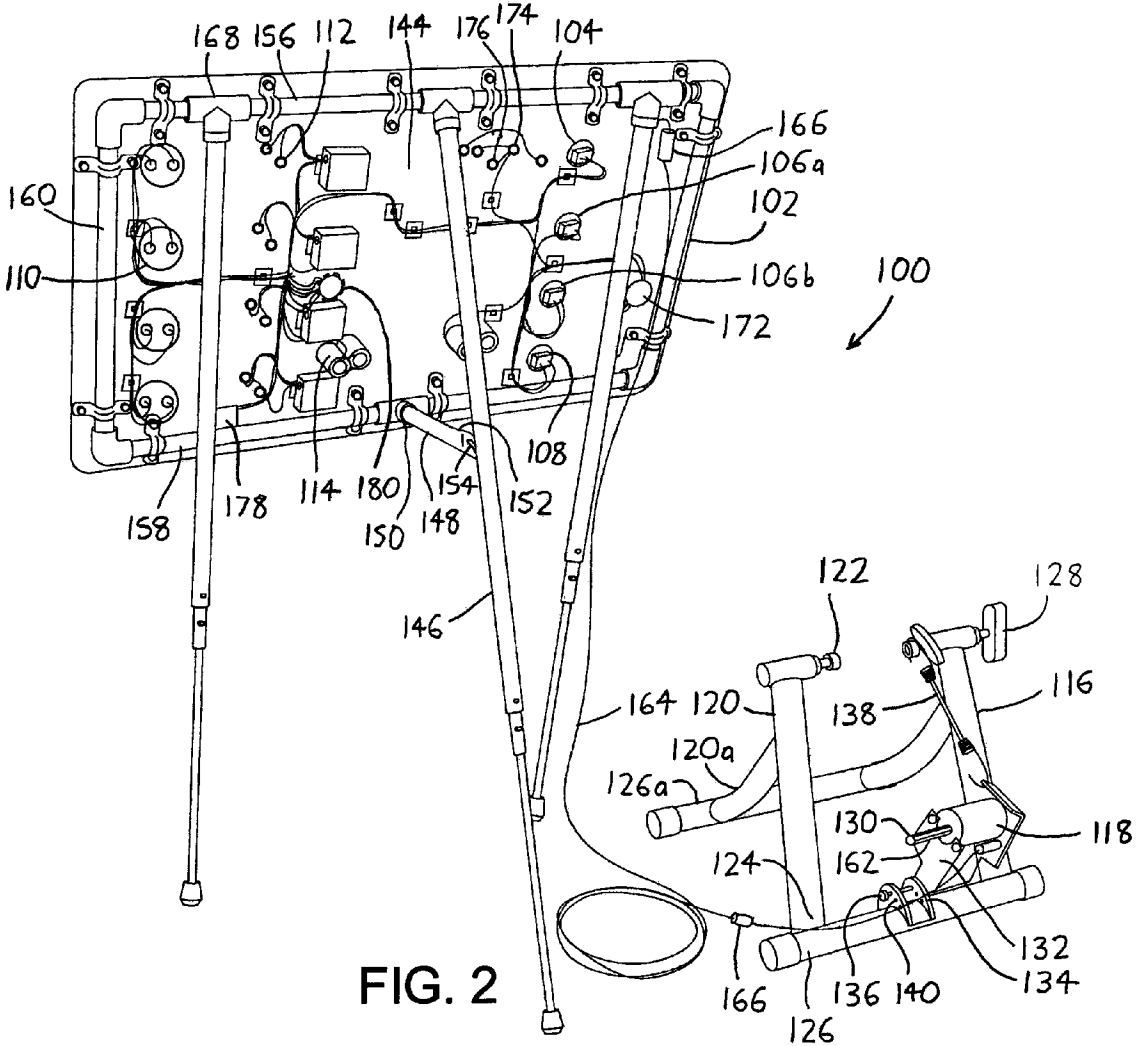
FIG. 2 is a rear perspective view of the electrical generation kit 100 of FIG. 1, shown without the bicycle 200.

To elaborate on the discussion above, following are further details regarding the preferred exemplary version of the electrical generation kit 100 illustrated in the drawings, as well as selected modifications that can be made to the kit 100.

The bicycle wheel support 116 may be capable of folding into a compact configuration, with the supplementary support legs 120*a* and supplementary support base 126*a* being pivotable on the support legs 120 to unfold to the position illustrated in the drawings (at which point they might be prevented from unfolding further without encountering interference). Thus, along with the pivotable generator mount 132, the bicycle wheel support 116 can be folded into a relatively flat state and can be stowed in a carrying case/suitcase along with the display board 102 for easy transport. The bicycle wheel support 116 is preferably made out of steel or other metals for sake of strength, though it could be made of composite or plastic materials instead if lighter weight is desired.

The axle engagements 122 of the bicycle wheel support 116 may take a variety of forms, e.g., a simple pair of opposing cups wherein at least one of the cups is inwardly movable towards the other to engage the axle on the driven wheel 202 of a bicycle 200. A particularly preferred version of the axle engagements 122 has threading on the interior of one of the cups, with the other simply being a smooth cup. The threaded cup is then threaded onto the axle of the bicycle wheel 202, with the other cup moved into surrounding engagement on the opposite side of the axle.

The pivotable mounting of the generator mount 132 to travel in an orbit intersecting the outer circumferences of variously-sized bicycle wheels 202 is highly useful to allow the bicycle 200 from virtually any participant/observer to be used in the kit 100, i.e., the bicycle wheel support 116 can accommodate bicycle wheels 202 of both children's bicycles and adult bicycles. Forms of elastic biasing other than the bungee cord 138 can be used to urge the generator shaft 130 onto the wheel 202, e.g., the generator mount 132 might be mounted on the support base 126 (or another part of the generator mount 132, e.g., on a support leg 120) by a torsion or other spring. However, the bungee cord 138 is useful for its simplicity, low cost, and easy removability and replaceability (including with bungee cords of other sizes/tensions, thereby allowing the contact between the generator shaft 130 and bicycle wheel 202 to be readily readjusted as desired).

The generator 118 of the bicycle wheel support 116 is a conventional 12 volt DC generator, though DC or AC generators of other ratings could be used instead. The generator 118 may be connected to the display board 102 via a cable 164 of (preferably) 6-15 foot length, and with the cable 164 being connected to both the bicycle wheel support 116 and the display board 102 by a conventional electrical connector 166. The electrical connector 166 is most preferably a type which presents male and female interconnects which, when connected together, are sealed and latched (positively locked) together. As an example, automotive interconnects made by Deutsch Engineered Connecting Devices (Hemet, Calif., USA) are suitable, and are available with varying numbers of pins in varying configurations (though generally only two pins, i.e., two conductors, are needed from the generator 118, unless it is desired to split the output from the generator 118 prior to its reaching the display board 102). Such connectors 166 are particularly useful because they do not allow accidental cross-wiring (i.e., connection with a polarity the opposite of that which is desired), and they allow sturdy and rapid connection with easy disconnection.

In a working model of the display board 102 (as illustrated in the drawings), the board 102 is made of PVC sheet, and the reinforcing members (the top tubular support 156, bottom tubular support 158, and adjoining intermediate tubular supports 160) are made of schedule 40 PVC pipe which is attached to the display board 102 by aluminum pipe clamps. T-fittings 168 are used to rotatably connect the board support legs 146 and the leg support strut 148 to the top tubular support 156 and bottom tubular support 158. The board support legs 146 are formed of telescoping aluminum tubes which bear spring-biased buttons—similar to those found in collapsing/telescoping pole structures, e.g., in tent posts—which allow the telescopic segments of the board support legs 146 to be disengaged for collapse, or locked into extended positions. Rigid one-piece board support legs could be used in lieu of the telescoping board support legs 146, but the telescoping board support legs 146 are useful to allow the height of the display board 102 to be adjusted to accommodate the size and venue of the audience, and/or to accommodate the height of a bicycle 200 resting within the bicycle wheel support 116 (if the rider/driver is to operate the display board 102). The telescoping board support legs 146 also allow the display board 102 to be lowered for use by small children or by wheelchair users. However, it is also possible that the display board 102 might have no legs at all, and might be hung or otherwise suspended, or placed on the floor, for use.

As depicted in the drawings, one or two of the board support legs 146 may be extended and folded outwardly from the display board 102, and the remaining leg(s) 146 may be extended and left in its folded state against the display board 102, to form a tripod for supporting the display board 102. Thus, it is possible that one or more of the board support legs 146 need not fold with respect to the display board 102, e.g., the outer board support legs 146 could be fixed to simply telescopically extend from the display board 102 in a plane adjacent to that of the board 102, and the central leg 146 could fold outwardly from the display board 102 and be extended to define the supporting tripod. In an exemplary working model of the kit 100, the board support legs 146 are actually stored separately from the display board 102, and are installed into their T-fittings 168 after the board support legs 146 are telescopically expanded (and are removed and collapsed when the use of the display board 102 is completed). The leg support strut 148 remains connected to the display board 102, and it is folded inwardly on its T-fitting 168 adjacent the board 102 for storage, or is folded outwardly to have its end hook fall within a slot 154 in the unfolded central board support leg 146 for set-up of the display board 102. If it is felt that greater reinforcement against tipping is useful (e.g., where the display board 102 may be used outdoors on a windy day), the display board 102 can be used with leg base weights, and/or with bridging struts between the board support legs 146.

The display board 102 may be configured with a variety of components depending on the principles to be illustrated by the board 102. Thus, it is preferred that the kit 100 include a variety of different boards 102 for use, each having different components/activities. Alternatively, display boards may be provided with interchangeable components, or boards might be formed with interchangeable modules of components, e.g., exchangeable quadrants or other segments which are connectable together to provide different activities. The exemplary display board 102 illustrated in the drawings includes electrical output meters in the form of a voltmeter 104 (e.g., a 0-15 VDC voltmeter) and a pair of switchable ammeters 106*a* and 106*b* with different resolution (0-5 ADC and the other 0-30 ADC), allowing users to measure the power output from the bicycle 200. An additional electrical output meter 108 is also illustrated, and this could take a variety of forms, e.g., a wattmeter; another voltmeter or ammeter having different resolution; an AC voltmeter (which might be useful if an AC generator is used for generator 118, and if switchable rectification is provided so that observers can study differences between DC and AC power); etc. A calculator 170 may be provided on the display board 102 next to the output meters 104/106*a*/106*b*/108 to allow participants to readily calculate wattages or other quantities (e.g., RC time constants). A tablet PC or other more complex/expensive computing device might be used instead (and can be useful for recording data, generating reports or graphical displays; etc.), but a simple calculator 170 is preferred owing to cost, and also because a calculator 170 can better allow teaching of math principles. The circuit of the display board 102 is preferably protected by means of a 25 A fuse (not shown) downstream from the connection between the cable 164 and the display board 102, and upstream from the output meters 104/106*a*/106*b*/108. The voltmeter 104 is continuously connected to the display board 102 circuit, but only one or the other of the ammeters 106*a*/106*b* may be selected at a time by a SPDT toggle switch 172. The center position of the switch 172 effectively removes power from the display board 102, thereby better allowing demonstration of the uses and properties of capacitors 174, two of which are installed on the display board 102 and which may be added to or removed from the display board circuit by means of a SPST toggle switch 176. Four sockets 114 are provided on the load side of the ammeters 106*a*/106*b*, allowing various accessories (including other/additional display boards) to be added to the circuit. Preferred accessories include an electric fan, a transistor radio, and a hair dryer, all of these being 12 VDC units with plugs adapted to fit the sockets 114 provided on the display board 102.

Two banks of lamps 110/112 are also provided in parallel connection with the four sockets 114, with one bank consisting of four incandescent lamps 110 and the other bank including fluorescent lamps 112, thereby allowing participants to see the difference in power consumption and light output between the two types of lamps. Selection of either bank of lamps is controlled with a SPDT toggle switch 178, with the center position allowing participants to remove the banks of lamps 110/112 from the display board circuit. When a bank of lamps 110/112 is selected, the lamps 110/112 can be incrementally activated by means of a rotary switch 180 that has been fitted with diodes. Diodes are also placed on the ground side of the individual incandescent lamps 110 in order to prevent the backfeeding of voltage into the circuit. All wiring is systematically routed and harnessed according to industrial panel wiring standards, with all splices crimped and tinned before being protected by heat shrink.

The various elements of the display board 102 are labeled on the front board face 142 with vinyl lettering or other labeling; this is not shown in the drawings, but as depicted in FIG. 1, the front board face 142 is depicted with ample "blank space" wherein labeling and explanatory descriptions of the board components and their operation can be added. The bottom of the display board 102 may include hooks 182 for hanging accessories during presentations. For durability and easy transport, the kit 100 preferably includes a wheeled case (not shown), similar to a suitcase or business case, which is sized to contain the display board 102, bicycle wheel support 116, and any accessories.

Other display boards 102 and/or accessories that are useful include a BTU measurement kit consisting of a measuring cup, a thermometer and a submersible heater (allowing a demonstration of how much energy is in one BTU, which requires that one pound of water at room temperature be heated by one degree Fahrenheit); and a circuit breaker kit that allows current to be directed to selected fuses, and to selected wires of different diameters (or components of different ratings/capacities), for safety discussions. The contents of display boards 102 can vary in dependence on their intended audience; for example, where the kit 100 is to be used with small children, the display board 102 could be wall-mounted, and could have a simplified display board design that gives young children an option to select music, compact fluorescent lights, incandescent lights, LED's, a moving object (a toy of some sort), etc., and it could be powered by tricycles or other child-powered vehicles rather than by a bicycle 200. For teenagers, display boards 102 might include Jacob's ladders, plasma globes, or other visually attractive devices to generate visual interest and excitement.

It should be understood that a preferred version of the kit 100 was described above and shown in the drawings to illustrate how to make and use an exemplary model of the invention. However, it should be understood that the kit can vary significantly from the one shown in the drawings, and that the invention extends to other forms of the kit. Following is an exemplary list of modifications that can be made to the kit 100.

It could be useful to incorporate a multi-port parallel power adaptor to allow more than one bicycle 200 to power the display board 102. Alternatively, it can also be useful to provide the kit 100 with a battery or other power supply which allows the use of the display board 102 and accessories without the need for a bicycle 200. In similar respects, it is also possible to use the bicycle wheel support 116 to generate power for purposes other than powering the display board 102, e.g., it could charge a battery, or directly power one or more appliances.

Other devices for generating electricity from kinetic energy, potential energy, or other inputs could additionally or alternatively be used, e.g., a hand crank, a flywheel or elastic band which might be charged by a kinetic (motion) input or a potential energy input (e.g., a descending weight), a treadmill, etc. Solar cells, Stirling engines, thermoelectric (Thomson/Peltier) devices, windmills, and the like which are charged by ambient conditions might also or alternatively be used.

The form and layout of the display board 102 can vary, and can include structures such as hanging trays for storing accessories, chalkboards/dry erase pads, etc. The form of the supports for the display board 102 can vary as well. For example, the legs 146 could be replaced with horizontal (or nearly so) extensions, allowing the display board 102 to stand on a desk or table. Legs need not be included, and instead the display board 102 could be hung on a classroom chalkboard, bulletin board, or the like, or alternatively a folding stand (as on a picture frame) or other support could be used.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. An electrical generation kit comprising:

a. a bicycle wheel support, the bicycle wheel support including two or more bicycle wheel support legs, each bicycle wheel support leg including an axle engagement for engaging a bicycle wheel axle and a leg base spaced from the axle engagement, whereby a bicycle wheel may have its bicycle wheel axis engaged within the axle engagements with the leg bases rotatably supporting the bicycle wheel above the ground;

b. a generator having a generator shaft protruding therefrom;

c. a generator mount whereupon the generator is situated, wherein the generator mount is pivotally affixed with respect to the bicycle wheel support to have the axis of the generator shaft travel in an arc intersecting the circumference of any bicycle wheel engaged within the axle engagements;

d. an elastic member extending between the generator mount and the bicycle wheel support, whereby the elastic member biases the generator mount and the generator thereon toward any bicycle wheel engaged within the axle engagements;

e. a support base extending between at least two of the leg bases, b. a bridge member extending from the support base, wherein the bridge member has two or more adjustment rod apertures defined therein;

c. a generator adjustment rod extending from the bridge member, wherein:

(1) the generator mount pivots about the generator adjustment rod, and (2) the generator adjustment rod may be fit into a selected one of the adjustment rod apertures to allow the generator mount to pivot about a selected axis.

2. The electrical generation kit of claim 1 wherein:

a. the generator mount is pivotally affixed to rotate about a generator adjustment axis, the generator adjustment axis being fixed with respect to the bicycle wheel support, and b. the generator mount is also translatable along the generator adjustment axis.

3. The electrical generation kit of claim 1 wherein the generator shaft has teeth protruding therefrom.

4. The electrical generation kit of claim 1 wherein at least one of the axle engagements is threadably affixed to its bicycle wheel support leg, whereby the axle engagement may be threadably extended toward the other axle engagement.

5. The electrical generation kit of claim 1 further comprising a display board, the display board including:

a. one or more electrical output meters connected to the generator, the electrical output meters including one or more of:

(1) a voltmeter;

(2) an ammeter; and (3) a wattmeter;

b. one or more electrical loads in connection with, or being switchably connected to, the generator.

6. The electrical generation kit of claim 5 wherein the display board includes a front board face whereupon at least one of the electrical output meters are situated, and a rear board face including:

a. at least three telescopically extendable board support legs, at least one of the board support legs being pivotally mounted to swing about an axis with respect to the rear board face;

b. one or more leg support struts, with each leg support strut being pivotally mounted to swing about an axis with respect to the rear board face to swing into engagement with a board support leg.

7. The electrical generation kit of claim 1 further comprising a display board, the display board including a front board face bearing:

a. a first set of loads;

b. a second set of loads, the second set of loads being different from the first set of loads;

c. a switch allowing energization of a selected one of the first and second sets of loads;

d. a dial allowing energization of a selected one or more of the loads in:

(1) the first set of loads, when the first set of loads is energized, and (2) the second set of loads, when the second set of loads is energized.

8. An electrical generation kit comprising:

a. a bicycle wheel support, the bicycle wheel support including:

(1) two or more bicycle wheel support legs, each bicycle wheel support leg including an axle engagement for engaging a bicycle axle, and a leg base spaced from the axle engagement;

(2) a generator having a generator shaft protruding therefrom, the generator being rotatable with respect to the bicycle wheel support legs to have the axis of the generator shaft orbit a generator adjustment axis, wherein the generator adjustment axis is spaced from a bicycle axle axis extending between the axle engagements;

b. a display board supported above the ground in an at least substantially vertical orientation, the display board including:

(1) one or more electrical output meters connected to the generator, the electrical output meters including one or more of:

(a) a voltmeter;

(b) an ammeter; and (c) a wattmeter;

(2) one or more electrical loads in connection with, or being switchably connected to, the electrical output meters;

c. a support base extending between at least two of the leg bases, d. a bridge member extending from the support base, the bridge member having adjustment rod apertures defined therein;

e. a generator adjustment rod fit into a selected one of the adjustment rod apertures to extend from the bridge member, wherein:

(1) the generator mount pivots about the generator adjustment rod, and (2) the generator adjustment rod is selectively placeable into one of the adjustment rod apertures to allow the generator mount to pivot about a selected axis.

9. The electrical generation kit of claim 8 further comprising one or more electrical sockets on the display board, wherein at least some of the one or more electrical loads are connected to the display board through one or more of the electrical sockets.

10. The electrical generation kit of claim 8 wherein the generator is elastically biased about the generator adjustment axis to swing toward the axle engagement.

11. The electrical generation kit of claim 8 further comprising an elastic member extending between the generator and one of the bicycle wheel support legs.

12. The electrical generation kit of claim 8 wherein the display board includes a front board face whereupon at least one of the electrical output meters are situated, and a rear board face including:

a. at least three board support legs arrayed in a row across the rear board face, with at least one of the board support legs being pivotally mounted to swing about an axis with respect to the rear board face, with each board support leg being telescopically extendable;

b. one or more leg support struts, with each leg support strut being pivotally mounted to swing about an axis with respect to the rear board face to swing into engagement with a board support leg.

13. The electrical generation kit of claim 8 wherein the display board includes a front board face bearing:

a. a first set of loads;

b. a second set of loads, the second set of loads being different from the first set of loads;

c. a switch allowing energization of a selected one of the first and second sets of loads;

d. a dial allowing energization of a selected one or more of the loads in:

(1) the first set of loads, when the first set of loads is energized, and (2) the second set of loads, when the second set of loads is energized.

14. An electrical generation kit comprising:

a. a bicycle wheel support including a generator, the bicycle wheel support being adaptable to receive the wheel of a bicycle therein to drive the generator;

b. a display board supported above the ground in an at least substantially vertical orientation, the display board including:

(1) a rear board face including:

(a) at least three board support legs arrayed in a row across the rear board face, with at least one of the board support legs being rotatably mounted to swing about an axis with respect to the rear board face, with each board support leg being telescopically extendable;

(b) one or more leg support struts, with each leg support strut being pivotally mounted to swing about an axis with respect to the rear board face to swing into engagement with a board support leg;

(c) tubular supports, the tubular supports including:

i. a top tubular support running horizontally along the rear board face, wherein the board support legs are all pivotally mounted to swing about the top tubular support; and ii. a bottom tubular support running horizontally along the rear board face below the top tubular support, wherein the leg support struts are pivotally mounted to swing about the bottom tubular support;

(2) a front board face bearing one or more electrical output meters connected to the generator, the electrical output meters including one or more of:

(a) a voltmeter;

(b) an ammeter; and (c) a wattmeter.

15. The electrical generation kit of claim 14 wherein the front board face also bears one or more electrical sockets therein, to which electrical loads may be connected.

16. The electrical generation kit of claim 14 wherein the bicycle wheel support includes:

a. two or more bicycle wheel support legs, each bicycle wheel support leg including an axle engagement for engaging a bicycle axle, and a leg base spaced from the axle engagement;

b. a generator having a generator shaft protruding therefrom, the generator being pivotally affixed with respect to the bicycle wheel support legs whereby the axis of the generator shaft travels in an arc about a generator adjustment axis spaced from a bicycle axle axis extending between the axle engagements; and c. an elastic member biasing the generator shaft toward the bicycle axle axis.

17. The electrical generation kit of claim 14 wherein each leg support strut includes a pivot end pivotally mounted to swing about an axis with respect to the rear board face and an opposing engagement end, wherein the engagement end bears an aperture configured to engage one of the leg support struts.

18. The electrical generation kit of claim 17 wherein the aperture defines a hook in the engagement end, and wherein at least one of the leg support struts bears a slot into which the hook of the engagement end of the support strut is fit.

19. The electrical generation kit of claim 14 wherein the top tubular support and bottom tubular support are engaged by two or more intermediate tubular supports.

20. The electrical generation kit of claim 14 wherein the front board face further bears:

a. a first set of loads;

b. a second set of loads, the second set of loads being different from the first set of loads;

c. a switch allowing energization of a selected one of the first and second sets of loads;

d. a dial allowing energization of a selected one or more of the loads in:

(1) the first set of loads, when the first set of loads is energized, and (2) the second set of loads, when the second set of loads is energized.

* * * * *